US007752864B2

(12) United States Patent
Takegami et al.

(10) Patent No.: US 7,752,864 B2
(45) Date of Patent: Jul. 13, 2010

(54) REFRIGERATION APPARATUS

(75) Inventors: Masaaki Takegami, Osaka (JP); Takeo Ueno, Osaka (JP); Kenji Tanimoto, Osaka (JP); Satoru Sakae, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 476 days.

(21) Appl. No.: 11/659,121

(22) PCT Filed: Aug. 1, 2005

(86) PCT No.: PCT/JP2005/014062

§ 371 (c)(1),
(2), (4) Date: Feb. 1, 2007

(87) PCT Pub. No.: WO2006/013834

PCT Pub. Date: Feb. 9, 2006

(65) Prior Publication Data

US 2009/0007589 A1 Jan. 8, 2009

(30) Foreign Application Priority Data

Aug. 2, 2004 (JP) ..... 2004-225494

(51) Int. Cl.
*F25B 13/00* (2006.01)

(52) U.S. Cl. ..... 62/324.1; 62/176.3; 62/498

(58) Field of Classification Search ..... 62/324.1, 62/176.3, 193, 498
See application file for complete search history.

(56) References Cited

U.S. PATENT DOCUMENTS

| | | | | |
|---|---|---|---|---|
| 5,249,432 | A * | 10/1993 | Ichikawa | 62/197 |
| 6,131,401 | A * | 10/2000 | Ueno et al. | 62/175 |
| 6,405,554 | B1 * | 6/2002 | Kawakatu et al. | 62/335 |

FOREIGN PATENT DOCUMENTS

| | | | |
|---|---|---|---|
| CN | 1436978 | A | 8/2003 |
| EP | 1334852 | A2 | 8/2003 |
| JP | 1-222165 | A | 9/1989 |
| JP | 2-78870 | A | 3/1990 |
| JP | 11-270946 | A | 10/1999 |
| JP | 11-351685 | A | 12/1999 |
| JP | 3253283 | B2 | 11/2001 |
| JP | 2003-75022 | A | 3/2003 |

* cited by examiner

*Primary Examiner*—Melvin Jones
(74) *Attorney, Agent, or Firm*—Birch, Stewart, Kolasch, & Birch, LLP.

(57) ABSTRACT

A refrigeration apparatus (1) is provided with a refrigerant circuit (1E) along which are connected a compressor (2), an outdoor heat exchanger (4), an expansion mechanism, an indoor heat exchanger (41) for providing room air conditioning, and a cooling heat exchanger (45, 51) for providing storage compartment cooling. The refrigerant circuit (1E) includes a discharge side three way switch valve (101) for varying the flow rate of a portion of the refrigerant which is discharged out of the compressor (2) and then distributed to the indoor heat exchanger (41) and the outdoor heat exchanger (4) during a heat recovery operation mode in which the indoor heat exchanger (41) and the outdoor heat exchanger (4) operate as condensers. As a result of such arrangement, even when the amount of heat obtained in the cooling heat exchanger (45, 51) exceeds the amount of heat required in the indoor heat exchanger (41), surplus heat is discharged without excessive decrease in the discharge pressure of the compressor (2).

10 Claims, 6 Drawing Sheets

REFRIGERATION APPARATUS

TECHNICAL FIELD

The present invention generally relates to the field of refrigeration apparatuses. This invention is concerned in particular with a refrigeration apparatus which is provided with an air conditioning heat exchanger and a cooling heat exchanger.

BACKGROUND ART

Refrigeration apparatuses, configured to perform refrigeration cycles and typically used, for example, as air conditioners for providing room cooling/heating and coolers for refrigerators for the cold storage of foodstuffs, have been known for many years in the conventional technology. Some of these refrigeration apparatuses provide both air conditioning and cold storage compartment cooling. This type of refrigeration apparatus includes a plural number of utilization side heat exchangers such as air conditioning heat exchangers and cooling heat exchangers, and is usually installed in convenience stores et cetera. The installation of a single refrigeration apparatus of such a type makes it possible to provide both store air conditioning and showcase cooling (see, for example, the following patent documents I and II).

In a refrigeration apparatus of the above described type, it is possible for an air conditioning heat exchanger to make efficient use of heat absorbed, for example in a showcase cooling heat exchanger.

Patent Document I: Japanese Patent No. 3253283

Patent Document II: JP-A-2003-75022

DISCLOSURE OF THE INVENTION

Problems that the Invention Intends to Solve

However, when in the above-described refrigeration apparatus the amount of heat absorbed in the cooling heat exchanger exceeds the amount of heat required in the air conditioning heat exchanger, surplus heat has to be drawn out, otherwise the compressor discharge pressure in the refrigerant circuit of the refrigeration apparatus will become too high. In such a case, in the conventional technology the refrigerant flow direction is changed by a four way switch valve disposed along a discharge pipe of the compressor, whereby the refrigerant on the discharge side of the compressor is made to flow into the heat source side heat exchanger and surplus heat is drawn out. However, since the refrigerant flow direction is merely changed by the four way switch valve, in other words it is impossible to make fine adjustment of the flow rate of the refrigerant flowing into the heat source side heat exchanger. As a result, the discharge pressure of the compressor becomes too low and the room heating capacity falls to a lower level, thereby causing a problem in that it becomes impossible to provide comfortable air conditioning.

With the above problem in mind, the present invention was made. Accordingly, an object of the present invention is to provide an improved refrigeration apparatus whereby, when the amount of heat obtained in the cooling heat exchanger exceeds the amount of heat required in the air conditioning heat exchanger, surplus heat can be drawn out while the discharge pressure of the compressor is prevented from becoming too low.

Means for Solving the Problems

In order to achieve the above-described object, the present invention employs a flow rate controller means (101, 104) which is configured to controllably distribute the refrigerant discharged out of a compressor (2) to a heat source side heat exchanger (4) and an air conditioning heat exchanger (41).

More specifically, the present invention provides, as a first aspect, a refrigeration apparatus comprising a refrigerant circuit (1E) along which are connected a compressor (2), a heat source side heat exchanger (4), an expansion mechanism (46, 52, 104), an air conditioning heat exchanger (41) for providing room air conditioning, and a cooling heat exchanger (45, 51) for providing storage compartment cooling.

In the refrigeration apparatus of the first aspect of the present invention, the refrigerant circuit (1E) further includes a flow rate controller means (101, 104) for varying the flow rate of refrigerant discharged out of the compressor (2) and then distributed to the air conditioning heat exchanger (41) and the heat source side heat exchanger (4) during a heat recovery operation mode in which the air conditioning heat exchanger (41) and the heat source side heat exchanger (4) operate as condensers.

When the amount of heat absorbed in the cooling heat exchanger (45, 51) during the heat recovery operation mode in which the air conditioning heat exchanger (41) and the heat source side heat exchanger (4) operate as condensers exceeds the amount of heat required in the air conditioning heat exchanger (41), surplus heat has to be drawn out, otherwise the discharge pressure of the compressor (2) of the refrigerant circuit (1E) will become too high. However, according to the configuration of the first aspect of the present invention, by means of the flow rate controller means (101, 104), the refrigerant discharged out of the compressor (2) is distributed, in proper amounts, to the air conditioning heat exchanger (41) and the heat source side heat exchanger (4), to the balance between the amount of heat absorbed in the cooling heat exchanger (45, 51) and the amount of heat required in the air conditioning heat exchanger (41).

The present invention provides, as a second aspect, a refrigeration apparatus in which the flow rate controller means is formed by a three way switch valve (101) which is connected to a discharge pipe (5) of the compressor (2) and which is capable of flow path switching and flow rate control.

According to the configuration of the second aspect of the present invention, the refrigerant discharged out of the compressor (2) can be distributed, in proper amounts, to the air conditioning heat exchanger (41) and the heat source side heat exchanger (4) by the three way switch valve (101) capable of flow rate control.

The present invention provides, as a third aspect, a refrigeration apparatus in which the flow rate controller means is composed of a three way switch valve (101) which is connected to a discharge pipe (5) of the compressor (2) and which is capable of flow path switching and an expansion valve (104) which is connected to an end of the heat source side heat exchanger (4), the end serving as a downstream side thereof during the heat recovery operation mode, and the opening of which is controllable.

According to the configuration of the third aspect of the present invention, even when the switch valve (101) does not have a flow rate control function, the refrigerant discharged out of the compressor (2) can be distributed in proper amounts to the air conditioning heat exchanger (41) and the heat source side heat exchanger (4) by controlling the opening of the expansion valve (104) disposed in the heat source side heat exchanger (4) and capable of being electronically controlled.

The switch valve (101) may be implemented by a three way switch valve or by a four way switch valve.

The present invention provides, as a fourth aspect, a refrigeration apparatus in which an inhibitor means (81) is provided which inhibits the condensing capacity of the air conditioning heat exchanger (41) from lowering when the refrigerant flow rate is varied by the flow rate controller means (101, 104).

According to the configuration of the fourth aspect of the present invention, it is ensured without fail that the air conditioning heat exchanger (41) secures a predetermined heating capacity.

The present invention provides, as a fifth aspect, a refrigeration apparatus in which the inhibitor means (81) decreases the air volume of a heat source fan (4F) of the heat source side heat exchanger (4).

The present invention provides, as a sixth aspect, a refrigeration apparatus in which the inhibitor means (81) increases the air volume of a cooling fan (47, 58) of the cooling heat exchanger (45, 51).

The present invention provides, as a seventh aspect, a refrigeration apparatus in which the expansion mechanism (46, 52) of the cooling heat exchanger (45, 51) is formed by an expansion valve the opening of which is controllable and the inhibitor means (81) increases the opening of the expansion mechanism (46, 52) of the cooling heat exchanger (45, 51).

The present invention provides, as an eighth aspect, a refrigeration apparatus in which the compressor (2) has a variable volume and the inhibitor means (81) increases the volume of the compressor (2).

The present invention provides, as a ninth aspect, a refrigeration apparatus in which the compressor (2) is provided in plural number and the inhibitor means (81) increases the number of compressors (2) of the plural compressors (2) to be operated.

The present invention provides, as a tenth aspect, a refrigeration apparatus in which an auxiliary passageway (90) is provided allowing the refrigerant to be bypassed between the discharge and suction sides of the compressor (2) and the auxiliary passageway (90) is made fluidly communicative by the inhibitor means (81).

The present invention provides, as an eleventh aspect, a refrigeration apparatus in which the inhibitor means (81) increases the air volume of an air conditioning fan (43) of the air conditioning heat exchanger (41).

ADVANTAGEOUS EFFECTS OF THE INVENTION

As described above, in accordance with the first aspect of the present invention, the refrigerant discharged out of the compressor (2) is flow-rate controlled by the flow rate controller means (101) and then distributed to the air conditioning heat exchanger (41) and the heat source side heat exchanger (4). This therefore makes it possible to not only supply to the air conditioning heat exchanger (41) an amount of heat just required in the air conditioning heat exchanger (41) of the heat absorbed in the cooling heat exchanger (45, 51) during the heat recovery operation mode but also discharge surplus heat in the heat source side heat exchanger (4).

Accordingly, the discharge pressure of the compressor (2) will not be excessively lowered, thereby making it possible to provide comfortable air conditioning.

In addition, it is possible to properly collect heat absorbed in the cooling heat exchanger (45, 51), thereby making it possible to accomplish a marked improvement in heat efficiency.

In accordance with the second aspect of the present invention, the refrigerant discharged out of the compressor (2) is distributed in proper amounts to the air conditioning heat exchanger (41) and the heat source side heat exchanger (4) by means of the three way switch valve (101) capable of both flow path switching and flow rate control. This therefore makes it possible to accomplish an improvement in efficiency by a simplified configuration having a less number of component parts.

In accordance with the third aspect of the present invention, the refrigerant discharged out of the compressor (2) is distributed to the air conditioning heat exchanger (41) and the heat source side heat exchanger (4) by the switch valve (101) capable of flow path switching and the expansion valve (104) capable of being electronically controlled. This therefore makes it possible to accomplish an improvement in efficiency by means of the switch valve (101) having a simplified configuration without a flow rate control function.

In accordance with the fourth to eleventh aspects of the present invention, the condensing capacity of the air conditioning heat exchanger (41) is inhibited from lowering when the refrigerant is being distributed to the air conditioning heat exchanger (41) and the heat source side heat exchanger (4) by the flow rate controller means (101), and it is ensured without fail that the air conditioning heat exchanger (41) secures a predetermined heating capacity.

REFERENCE NUMERALS IN THE DRAWINGS

Figure 1:
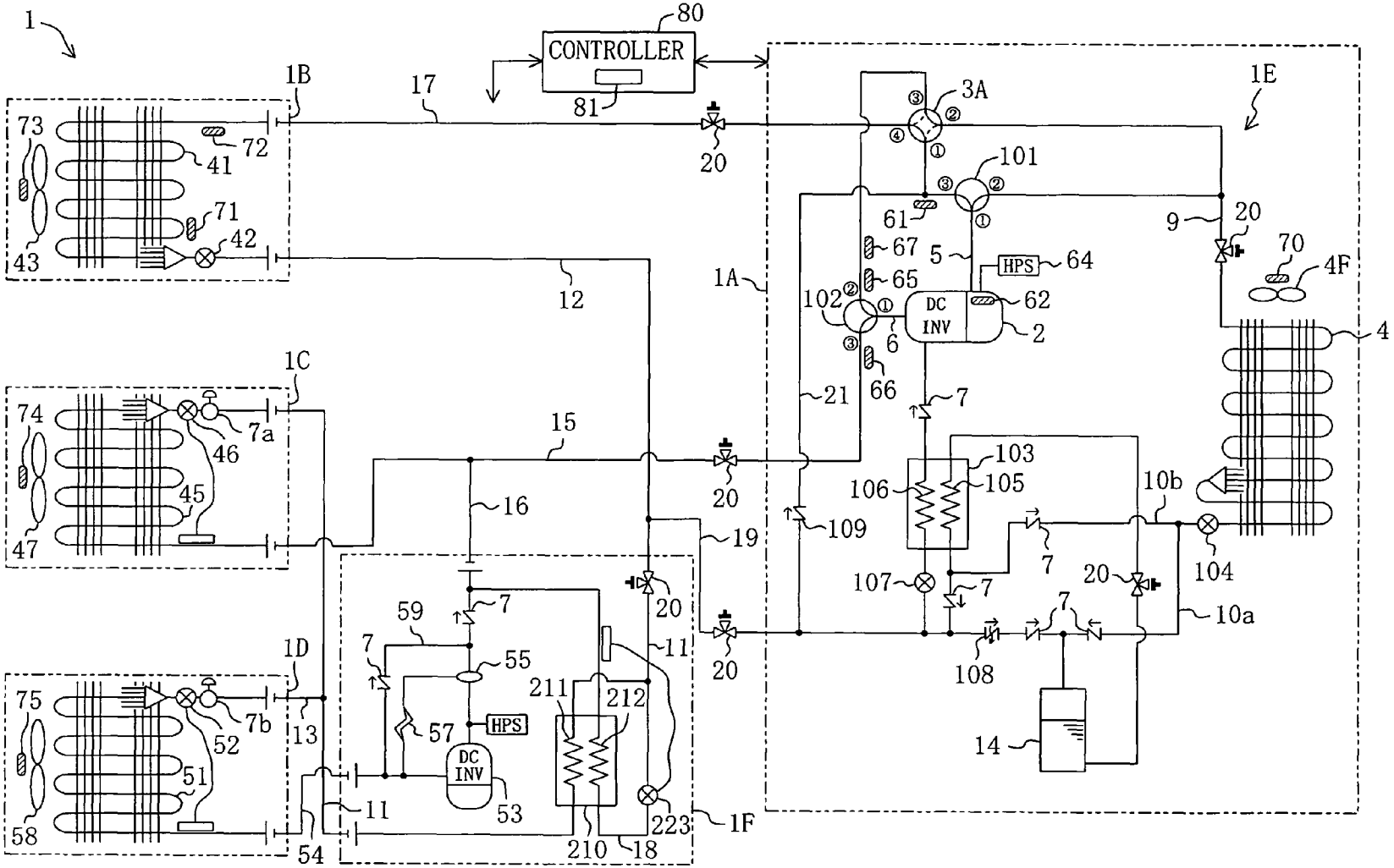
FIG. 1 is a circuit diagram which shows a refrigerant circuit of a refrigeration apparatus according to a first embodiment of the present invention.

1: refrigeration apparatus
1E: refrigerant circuit
2: compressor
4: outdoor heat exchanger (heat source side heat exchanger)
4F: outdoor fan (heat source fan)
5: discharge pipe
41: indoor heat exchanger (air conditioning heat exchanger)
43: indoor fan (air conditioning fan)
45: cold storage heat exchanger (cooling heat exchanger)
47: cold storage fan (cooling fan)
51: freeze storage heat exchanger (cooling heat exchanger)
58: freeze storage fan (cooling fan)
101: three way switch valve
104: expansion valve
81: inhibitor part (inhibitor means)

90: auxiliary passageway
91: auxiliary valve

BEST EMBODIMENT MODE FOR CARRYING OUT THE INVENTION

In the following, preferred embodiments of the present invention are described with reference to the accompanied drawings. It should be noted, however, that the following embodiments are essentially preferable examples which are not meant to limit the present invention, its application, or its range of application.

First Embodiment

Referring to FIG. 1, there is shown a refrigeration apparatus (1) according to a first embodiment of the present invention. The refrigeration apparatus (1) is installed, for example, in convenience stores, supermarkets et cetera and provides cooling in a showcase (not shown) and store air conditioning (cooling and heating).

The refrigeration apparatus (1) includes an outdoor unit (1A), an indoor unit (1B), a cold storage unit (1C), and a freeze storage unit (1D). The refrigeration apparatus (1) further includes a refrigerant circuit (1E) configured to perform a vapor compression refrigeration cycle. In addition, the refrigerant circuit (1E) is provided with a booster unit (1F). The refrigerant circuit (1E) further includes a first system circuit for cold storage/freeze storage and a second system circuit for air conditioning. The refrigerant circuit (1E) is configured such that its operation is switchable between a cooling cycle and a heating cycle.

The indoor unit (1B) is configured such that its operation is switchable between a cooling operation mode and a heating operation mode. The indoor unit (1B) is usually installed, for example, in the sales floor area. In addition, the cold storage unit (1C) is installed in a showcase for cold storage and cools the air inside the cold storage showcase. The freeze storage unit (1D) is installed in a showcase for freeze storage and cools the air inside the freeze storage showcase.

Outdoor Unit

The outdoor unit (1A) has an inverter compressor (2), a four way switch valve (3A), a discharge side three way switch valve (101) as a flow rate controller means, a suction side three way switch valve (102), an outdoor heat exchanger (4) as a heat source side heat exchanger, and an economizer heat exchanger (103).

The inverter compressor (2) is implemented, for example, by a hermetic screw compressor and is configured such that its volume can be varied in stages or continuously by inverter-controlling the electric motor. The inverter compressor (2) has a discharge pipe (5) connected to a first port of the discharge side three way switch valve (101). The operating volume of the inverter compressor (2) is controlled such that the refrigerant pressure of the first system circuit is constantly kept at a fixed value. During the heat recovery operation mode in which an indoor heat exchanger (41) operates as a condenser and the outdoor heat exchanger (4) also operates as a condenser, the operating volume of the inverter compressor (2) is controlled such that the pressure in the indoor heat exchanger (41) is kept constant. The inverter compressor (2) may be implemented by a scroll compressor.

A gas side end of the outdoor heat exchanger (4), situated on the side of the inverter compressor (2), is connected by an outdoor gas pipe (9) to the junction of a line extending from a second port of the discharge side three way switch valve (101) with a line extending from a second port of the four way switch valve (3A). The outdoor heat exchanger (4) has, at its liquid side end, an expansion valve (104) for room heating formed by a motor operated expansion valve the opening of which is controllable, and one end of a first liquid pipe (10*a*) which is a liquid line and one end of a second liquid pipe (10*b*) which is a liquid line are connected to the heating expansion valve (104). The heating expansion valve (104) decompresses the refrigerant during the room heating operation mode in which the outdoor heat exchanger (4) operates as an evaporator. The heating expansion valve (104) is controlled based on the suction temperature of the inverter compressor (2) detected by a suction temperature sensor (67) (descried later). The first liquid pipe (10*a*) is connected to a receiver's (14) inlet. Connected to the second liquid pipe (10*b*) is a first flow path (105) of the economizer heat exchanger (103).

The outdoor heat exchanger (4) is implemented, for example, by a fin and tube heat exchanger of the cross fin type. An outdoor fan (4F) as a heat source fan is disposed adjacently to the outdoor heat exchanger (4).

A suction pipe (6) of the inverter compressor (2) is connected to a first port of the suction side three way switch valve (102). A third port of the suction side three way valve (102) is connected, through a closing valve (20), to a low pressure gas pipe (15).

A first port of the four way switch valve (3A) is connected to the junction of a line extending from a third port of the discharge side three way switch valve (101) with a communicating pipe (21) (described later). A line extending from a third port of the four way switch valve (3A) is connected to a second port of the suction side three way switch valve (102). An interconnecting gas pipe (17) is connected, through a closing valve (20), to a line extending from a fourth port of the four way switch valve (3A).

Figure 2:
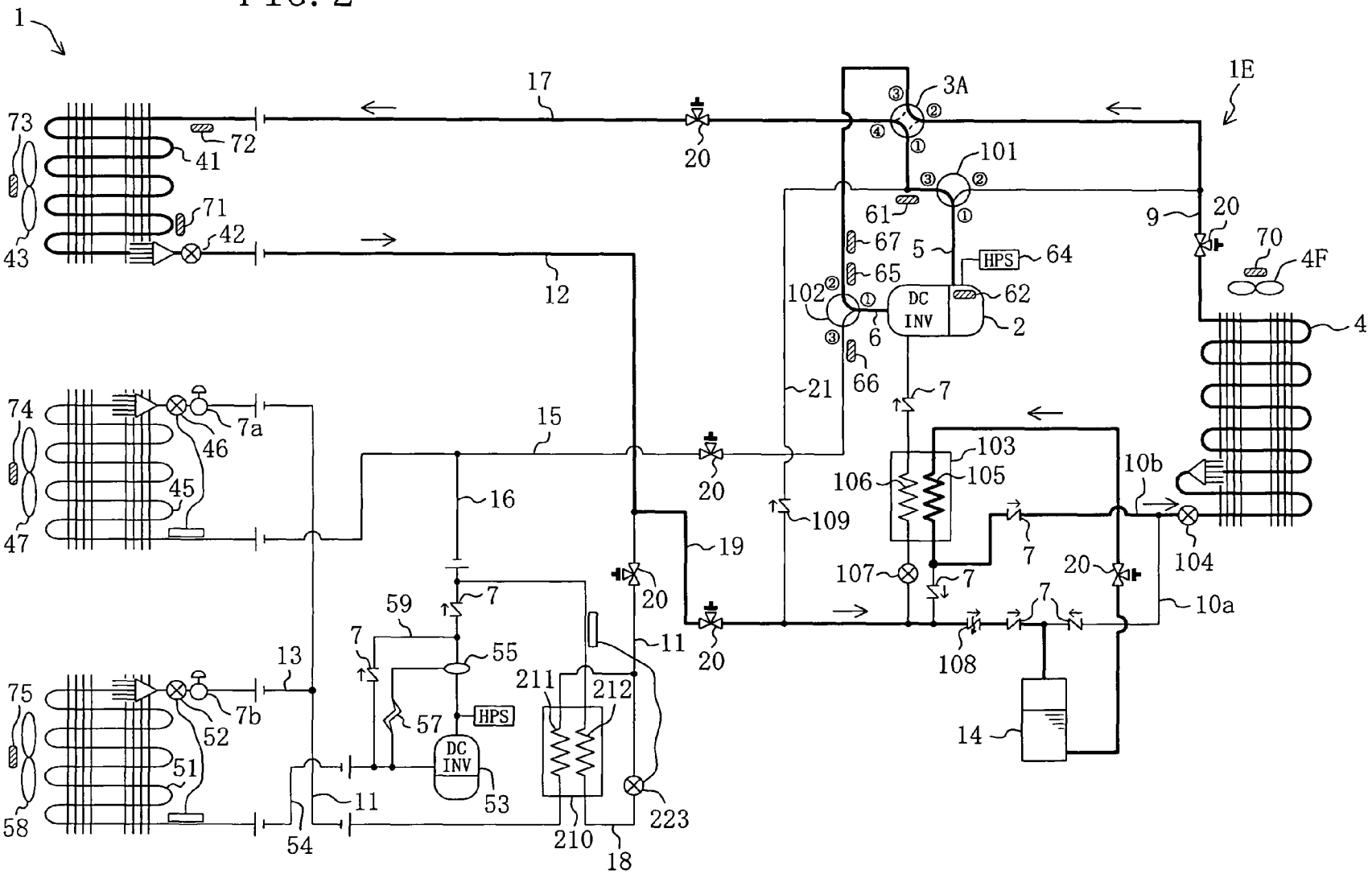
FIG. 2 is a refrigerant circuit diagram which shows the flow of refrigerant during a heating operation mode in the first embodiment.

The four way switch valve (3A) is configured, such that it can selectively change state between an ON state (indicated by the solid line of FIG. 2) and an OFF state (indicated by the broken line of FIG. 2). The ON state of the four way switch valve (3A) allows fluid communication between (a) the junction of the line extending from the third port of the discharge side three way switch valve (101) with the communicating pipe (21) and (b) the interconnecting gas pipe (17) and, in addition, allows fluid communication between (a) the junction of the outdoor gas pipe (9) with the line extending from the second port of the discharge side three way switch valve (101) and (b) the line extending from the second port of the suction side three way switch valve (102). On the other hand, the OFF state of the four way switch valve (3A) allows fluid communication between (a) the junction of the line extending from the third port of the discharge side three way switch valve (101) with the communicating pipe (21) and (b) the outdoor gas pipe (9) and, in addition, allows fluid communication between the interconnecting gas pipe (17) and the line extending from the second port of the suction side three way switch valve (102).

The interconnecting gas pipe (17), the low pressure gas pipe (15), and the connecting liquid pipe (19) are arranged so as to extend outwardly from the outdoor unit (1A), and their respective closing valves (20) are located within the outdoor unit (1A).

The economizer heat exchanger (103) is provided with a first flow path (105) and a second flow path (106). A line extending from one end of the first flow path (105) is connected to the outlet of the receiver (14). The other end of the first flow path (105) is connected to the junction of the connecting liquid pipe (19) with a line extending from the inlet of the receiver (14). One end of the second flow path (106) is connected, through a check valve (7), to an intermediate pressure part (not shown) of the inverter compressor (2). The other end of the second flow path (106) is connected, through an economizer motor operated expansion valve (107), to the junction of a line extending from the inlet of the receiver (14) with the connecting liquid pipe (19). As a result of this configuration, liquid refrigerant exiting from the outlet of the receiver (14) once passes through the first flow path (105) of the economizer heat exchanger (103). Subsequently, the refrigerant is decompressed by the economizer motor operated expansion valve (107). Then, the refrigerant passes through the second flow path (106), during which the refrigerant is supercooled in a low pressure state by the refrigerant in the first flow path (105). Then, this low pressure refrigerant is introduced into the intermediate pressure part of the inverter compressor (2). The economizer motor operated expansion valve (107) is controlled to the supercooling degree and the refrigerant temperature of the discharge pipe (5) of the inverter compressor (2). The check valve (7) is employed to prevent the refrigerant from flowing backward from the intermediate pressure part of the inverter compressor (2). By introduction of the supercooled, low pressure refrigerant into to the intermediate pressure part of the inverter compressor (2), the inverter compressor (2) is prevented from being overheated.

At the inlet of the receiver (14), check valves (7) are provided, respectively, on the side of the first liquid pipe (10*a*) and on the side of the first flow path (105) of the economizer heat exchanger (103), whereby the refrigerant is made to flow only in the direction towards the inlet of the receiver (14). In addition, a condensing pressure control valve (108) is disposed between the line extending from the inlet of the receiver (14) and the side of the first flow path (105) of the economizer heat exchanger (103). The condensing pressure control valve (108) is employed to avoid lack of refrigerant in the first system circuit when the temperature of outside air is low during the heating operation mode.

The communicating pipe (21) as an auxiliary line is connected between (a) the junction of the line extending from the first port of the four way switch valve (3A) with the line extending from the third port of the discharge side three way switch valve (101) and (b) the line extending towards the receiver (14) from the connecting liquid pipe (19). The communicating pipe (21) is provided with a spring-loaded check valve (109). The spring-loaded check valve (109) is configured such that it is not placed in operation under normal conditions. The spring-loaded check valve (109) is employed to prevent the occurrence of fluid leak when each valve is placed in the closed state, with the receiver (14) fully filled up with liquid refrigerant at shutdown.

Indoor Unit

The indoor unit (1B) includes, in addition to the indoor heat exchanger (41), an indoor expansion valve (42) as an expansion mechanism. The gas side of the indoor heat exchanger (41) is connected to the interconnecting gas pipe (17). On the other hand, the liquid side of the indoor heat exchanger (41) is connected, through the indoor expansion valve (42), to a second interconnecting liquid pipe (12). The second interconnecting liquid pipe (12) is connected to the connecting liquid pipe (19) extending to the outdoor unit (1A). The indoor heat exchanger (41) is, for example, a fin and tube heat exchanger of the cross fin type. An indoor fan (43) as an air conditioning fan is disposed adjacently to the indoor heat exchanger (41). In addition, although FIG. 1 shows only one indoor unit (1B), a plurality of indoor units (1B) may be connected in parallel with each other.

Cold Storage Unit

The cold storage unit (1C) includes a cold storage heat exchanger (45) as a cooling heat exchanger and a cold storage expansion valve (46) as an expansion mechanism. The liquid side of the cold storage heat exchanger (45) is connected, through a solenoid valve (7*a*) and the cold storage expansion valve (46), to a first interconnecting liquid pipe (11). On the other hand, the gas side of the cold storage heat exchanger (45) is connected to the low pressure gas pipe (15).

The cold storage heat exchanger (45) is in fluid communication through the low pressure gas pipe (15) with the third port of the suction side three way switch valve (102). On the other hand, the indoor heat exchanger (41) is in fluid communication through the interconnecting gas pipe (17) with the second port of the suction side three way switch valve (102) during the room cooling operation mode. By adjustment of the flow rate by the suction side three way switch valve (102), the refrigerant pressure (evaporating pressure) of the cold storage heat exchanger (45) becomes lower than the refrigerant pressure (evaporating pressure) of the indoor heat exchanger (41). Consequently, the refrigerant evaporating temperature of the cold storage heat exchanger (45) becomes, for example, minus 10 degrees Centigrade, while the refrigerant evaporating temperature of the indoor heat exchanger (41) becomes, for example, plus 5 degrees Centigrade, and the refrigerant circuit (1E) constitutes a circuit in which the refrigerant is evaporated at different temperatures.

The cold storage expansion valve (46) is an expansion valve of the temperature sensing type and its temperature sensing bulb is disposed on the gas side of the cold storage heat exchanger (45). The cold storage heat exchanger (45) is, for example, a fin and tube heat exchanger of the cross fin type. A cold storage fan (47) as a cooling fan is disposed adjacently to the cold storage heat exchanger (45).

Freeze Storage Unit

The freeze storage unit (1D) includes a freeze storage heat exchanger (51) as a cooling heat exchanger and a freeze storage expansion valve (52) as an expansion mechanism. The liquid side of the freeze storage heat exchanger (51) is connected, through a solenoid valve (7*b*) and the freeze storage expansion valve (52), to a branch liquid pipe (13) branched off from the first interconnecting liquid pipe (11).

The freeze storage expansion valve (52) is an expansion valve of the temperature sensing type and its temperature sensing bulb is disposed on the gas side of the freeze storage heat exchanger (51). The freeze storage heat exchanger (51) is, for example, a fin and tube heat exchanger of the cross fin type. A freeze storage fan (58) as a cooling fan is disposed adjacently to the freeze storage heat exchanger (51).

Booster Unit

The booster unit (1F) includes a booster compressor (53) and a supercooling heat exchanger (210).

In order that the refrigerant evaporating temperature of the freeze storage heat exchanger (51) may fall below the refrigerant evaporating temperature of the cold storage heat exchanger (45), the refrigerant is two-stage compressed, in other words the refrigerant is compressed by the inverter compressor (2) as well as by the booster compressor (53). The refrigerant evaporating temperature of the freeze storage heat exchanger (51) is set, for example, at minus 40 degrees Centigrade.

The gas side of the freeze storage heat exchanger (51) and the suction side of the booster compressor (53) are connected to each other by a connecting gas pipe (54). The discharge side of the booster compressor (53) is connected to a branch gas pipe (16) branched off from the low pressure gas pipe (15). The branch gas pipe (16) is provided with a check valve (7) and an oil separator (55). An oil return pipe (57) having a capillary tube is connected between the oil separator (55) and the connecting gas pipe (54).

A bypass pipe (59) having a check valve (7) is connected between the connecting gas pipe (54) on the suction side of the booster compressor (53) and the downstream side of the check valve (7) of the branch gas pipe (16) on the discharge side of the booster compressor (53). The bypass pipe (59) is configured so that, when the booster compressor (53) is stopped due to failure or the like, the refrigerant bypasses the booster compressor (53).

The supercooling heat exchanger (210) is implemented by a so-called plate heat exchanger. A plurality of first flow paths (211) and a plurality of second flow paths (212) are formed in the supercooling heat exchanger (210). A third interconnecting liquid pipe (18) is branched off from the first interconnecting liquid pipe (11). The first flow path (211) of the supercooling heat exchanger (210) forms a part of the first interconnecting liquid pipe (11), while the second flow path (212) forms a part of the third interconnecting liquid pipe (18).

A supercooling expansion valve (223) is disposed between the branch point at which the third interconnecting liquid pipe (18) branches off from the first interconnecting liquid pipe (11) and one side of the second flow path (212). The supercooling expansion valve (223) is implemented by an expansion valve of the temperature sensing type and its temperature sensing bulb is disposed on the opposite side of the second flow path (212).

The supercooling heat exchanger (210) is employed to effect heat exchange between a flow of refrigerant through the first flow path (211) and a flow of refrigerant through the second flow path (212), when the supercooling expansion valve (223) is placed in the open state. The refrigerant, cooled as a result of passage through the first flow path (211), is passed through the first interconnecting liquid pipe (11) and then flows to the cold storage heat exchanger (45) as well as to the freeze storage heat exchanger (51).

Control System

The refrigerant circuit (1E) is provided with various sensors and various switches. A high pressure sensor (61) for detecting the pressure of high pressure refrigerant is provided in the vicinity of the third port of the discharge side three way switch valve (101) of the outdoor unit (1A). The inverter compressor (2) is provided with a discharge temperature sensor (62) for detecting the temperature of high pressure refrigerant.

Low pressure sensors (65, 66) for detecting the pressure of low pressure refrigerant and a suction temperature sensor (67) for detecting the temperature of low pressure refrigerant are provided in the vicinity of the suction pipe (6) of the inverter compressor (2).

Additionally, the outdoor unit (1A) is provided with an outside air temperature sensor (70) for detecting the temperature of outside air.

The indoor heat exchanger (41) is provided with an indoor heat exchange sensor (71) for detecting the temperature of condensation or evaporation, i.e. the temperature of refrigerant, in the indoor heat exchanger (41), and a gas temperature sensor (72) for detecting the temperature of gas refrigerant is provided on the gas side thereof. In addition, the indoor unit (1B) is provided with a room temperature sensor (73) for detecting the temperature of indoor air.

The cold storage unit (1C) is provided with a cold storage temperature sensor (74) for detecting the compartment temperature of a cold storage showcase. The freeze storage unit (1D) is provided with a freeze storage temperature sensor (75) for detecting the compartment temperature of a freeze storage showcase.

Output signals from the various sensors and from the various switches are fed to a controller (80) (shown only in FIG. 1). The controller (80) is configured, such that it controls the volume of the inverter compressor (2).

In addition, the controller (80) controls the operation of the refrigerant circuit (1E) for establishing operation mode switching (cooling operation mode, refrigeration operation mode, cooling/refrigeration operation mode, heating operation mode, first heating/refrigeration operation mode, second heating/refrigeration operation mode, and third heating/refrigeration operation mode).

By control from the controller (80), the second port of the discharge side three way switch valve (101) is fully closed when the outdoor heat exchanger (4) becomes an evaporator, as a result of which all of the refrigerant flows towards the third port of the discharge side three way switch valve (101). On the other hand, when the indoor heat exchanger (41) becomes a condenser during the heating operation mode and is at thermo off, the third port is fully closed, as a result of which all of the refrigerant flows towards the second port. In addition, during the heat recovery operation mode in which the indoor heat exchanger (41) and the outdoor heat exchanger (4) each operate as a condenser, it is controlled such that the second port of the discharge side three way switch valve (101) is placed in the open state so that the discharge pressure falls below a certain level, when the high pressure sensor (61) detects that the discharge pressure of the inverter compressor (2) exceeds a certain level.

By control from the controller (80), the third port of the suction side three way switch valve (102) is constantly placed in the closed state when the first system circuit is not in use, i.e., when only the indoor unit (1B) is placed in operation.

In the present embodiment, the controller (80) is not provided with an inhibitor part (81) shown in FIG. 1.

Running Operation

Although the refrigeration apparatus (1) of the present embodiment performs the above-described operation modes, description will be made only in regard to the room heating mode in which the feature of the present invention appears.

The heating mode is selectively switched, by control exercised by the controller (80), to any one of the heating operation mode, the first heating/refrigeration operation mode, the second heating/refrigeration operation mode, and the third heating/refrigeration operation mode.

Heating Operation Mode

This heating operation mode is an operation mode which provides only heating by the indoor unit (1B). The four way switch valve (3A) changes state to the ON state, as indicated by the solid line of FIG. 6. The second port of the discharge side three way switch valve (101) is placed in the closed state. The third port of the suction side three way switch valve (102) is placed in the closed state. In addition, the solenoid valve (7*a*) of the cold storage unit (1C) and the solenoid valve (7*b*) of the freeze storage unit (1D) are placed in the closed state.

In the above state, refrigerant discharged out of the inverter compressor (2) passes through the third port of the discharge side three way switch valve (101), then through the four way switch valve (3A), and then through the interconnecting gas pipe (17) and flows into the indoor heat exchanger (41) where the refrigerant condenses to a liquid refrigerant. The liquid refrigerant flows through the second interconnecting liquid pipe (12) and enters the receiver (14). Subsequently, the liquid refrigerant flows, through the heating expansion valve (104), into the outdoor heat exchanger (4) where the refrigerant evaporates to a gas refrigerant. The gas refrigerant passes through the outdoor gas pipe (9), then through the four way switch valve (3A), and then through the suction side three way switch valve (102) and is returned back into the inverter compressor (2). This circulation is repeatedly performed to thereby effect room heating, i.e., store heating.

The opening of the heating expansion valve (104) is superheating degree controlled depending on the pressure corresponding saturation temperature based on the low pressure sensors (65, 66) and on the temperature detected by the suction temperature sensor (67). The opening of the indoor expansion valve (42) is supercooling degree controlled based on the temperature detected by the indoor heat exchange sensor (71). The opening of the heating expansion valve (104) and the indoor expansion valve (42) is controlled in the same way as the following heating operation modes.

First Heating/Refrigeration Operation Mode

The first heating/refrigeration operation mode is an operation mode which provides heating by the indoor unit (1B), cooling by the cold storage unit (1C), and cooling by the freeze storage unit (1D), without using the outdoor heat exchanger (4).

Figure 3:
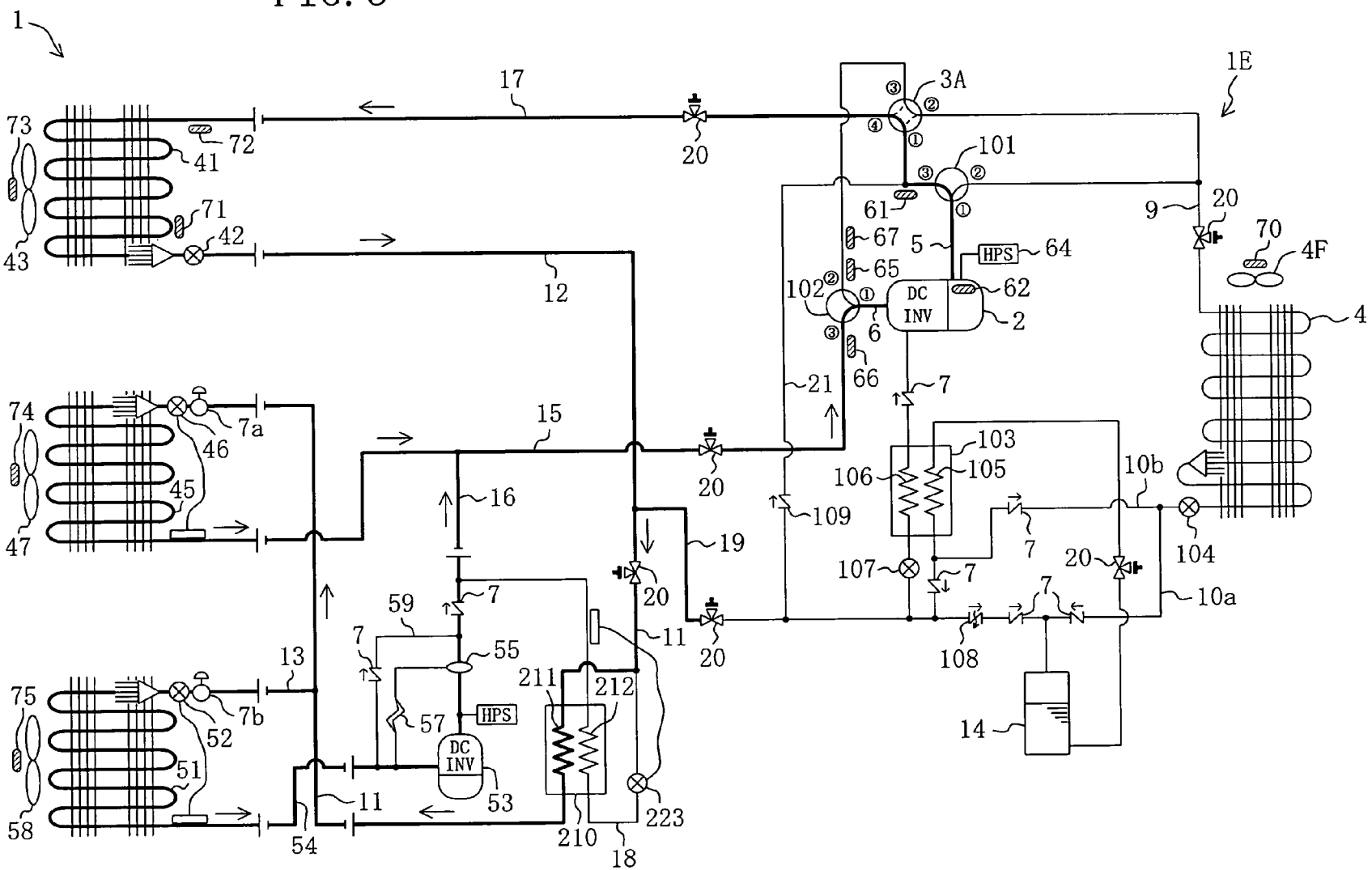
FIG. 3 is a refrigerant circuit diagram which shows the flow of refrigerant during a first heating/refrigeration operation mode in the first embodiment.

The four way switch valve (3A) changes state to the ON state, as indicated by the solid line of FIG. 3. The second port of the discharge side three way switch valve (101) is placed in the closed state. The second port of the suction side three way switch valve (102) is placed in the open state. Furthermore, the solenoid valve (7*a*) of the cold storage unit (1C) and the solenoid valve (7*b*) of the freeze storage unit (1D) are placed in the open state, while on the other hand the heating expansion valve (104) is placed in the closed state.

In the above state, all of the refrigerant discharged out of the inverter compressor (2) is fed towards the third port of the discharge side three way switch valve (101). The refrigerant passes through the four way switch valve (3A) and then through the interconnecting gas pipe (17) and flows into the indoor heat exchanger (41) where the refrigerant condenses to a liquid refrigerant. The liquid refrigerant flows through the second interconnecting liquid pipe (12) and then through the first interconnecting liquid pipe (11).

One part of the liquid refrigerant flowing through the first interconnecting liquid pipe (11) flows, through the cold storage expansion valve (46), into the cold storage heat exchanger (45) where the refrigerant evaporates to a gas refrigerant. On the other hand, the other part of the liquid refrigerant flowing through the first interconnecting liquid pipe (11) flows, through the branch liquid pipe (13) and then through the freeze storage expansion valve (52), into the freeze storage heat exchanger (51) where the refrigerant evaporates into a gas refrigerant. The gas refrigerant (i.e., the refrigerant evaporated in the freeze storage heat exchanger (51)) is drawn into the booster compressor (53), compressed there, and then expelled to the branch gas pipe (16).

The gas refrigerant (i.e., the refrigerant evaporated in the cold storage heat exchanger (45)) and the gas refrigerant expelled out of the booster compressor (53) join together in the low pressure gas pipe (15), and the merged refrigerant flow is returned back into the inverter compressor (2). This circulation is repeatedly performed to thereby effect room heating, i.e., store heating, while simultaneously effecting storage compartment cooling, i.e., cold storage showcase cooling and freeze storage showcase cooling. In other words, the refrigeration capacity of the cold and freeze storage units (1C, 1D), i.e. the amount of evaporation heat, is in balance with the heating capacity of the indoor unit (1B), i.e. the amount of condensation heat, whereby 100% heat recovery is achieved.

In addition, the opening of each of the cold stage expansion valve (46) and the freeze storage expansion valve (52) is superheat degree controlled by the temperature sensing bulb, which is the same as in each of the following operation modes.

Second Heating/Refrigeration Operation Mode

The second heating/refrigeration operation mode is a heating capacity excess operation mode in which the heating capacity of the indoor unit (1B) becomes surplus during the first heating/refrigeration operation mode.

Figure 4:
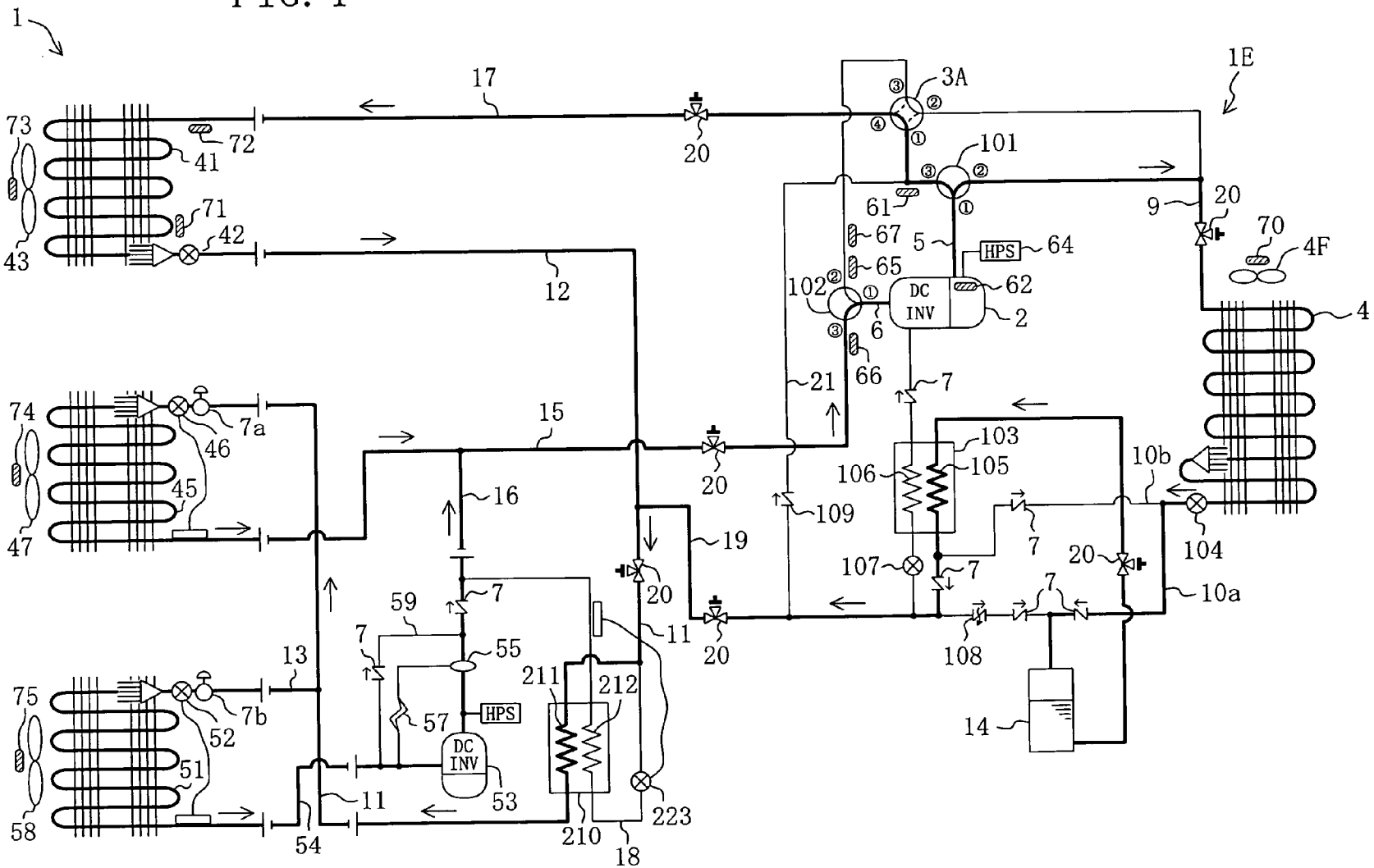
FIG. 4 is a refrigerant circuit diagram which shows the flow of refrigerant during a second heating/refrigeration operation mode in the first embodiment.

As shown in FIG. 4, the second heating/refrigeration operation mode is a heat recovery operation mode which is performed when the heating capacity of the indoor unit (1B) becomes surplus in the first heating/refrigeration operation mode.

As a feature of the present invention, upon detection by the high pressure sensor (61) that the discharge pressure of the inverter compressor (2) exceeds a certain level, the second port of the discharge side three way switch valve (101) is caused to open by control from the controller (80), and the refrigerant discharged out of the inverter compressor (2) is distributed by the discharge side three way switch valve (101). Stated another way, the refrigerant is passed through the third port to the indoor heat exchanger (41) at a flow rate capable of just giving an amount of condensation heat necessary in the indoor heat exchanger (41) where the refrigerant condenses to a liquid refrigerant. The liquid refrigerant flows through the second interconnecting liquid pipe (12) and then through the first interconnecting liquid pipe (11).

On the other hand, the rest of the refrigerant discharged out of the inverter compressor (2) passes through the second port of the discharge side three way switch valve (101) and is then distributed towards the outdoor gas pipe (9). Subsequently, in the outdoor heat exchanger (4) the refrigerant condenses to a liquid refrigerant. The liquid refrigerant flows through the first liquid pipe (10*a*), enters the receiver (14), passes through the connecting liquid pipe (19), and joins a flow of refrigerant which has passed through the indoor heat exchanger (41) in the first interconnecting liquid pipe (11).

Thereafter, one part of the refrigerant flowing through the first interconnecting liquid pipe (11) flows into the cold storage heat exchanger (45) where the one part refrigerant evaporates to a gas refrigerant. On the other hand, the other part of the refrigerant flowing through the first interconnecting liquid pipe (11) flows into the freeze storage heat exchanger (51) where the other part refrigerant evaporates to a gas refrigerant. The gas refrigerant (i.e., the refrigerant evaporated in the cold storage heat exchanger (45)) and the gas refrigerant (i.e., the refrigerant evaporated in the freeze storage heat exchanger (51) and discharged out of the booster compressor (53)) join together in the low pressure gas pipe (15), and the merged gas refrigerant flow passes through the third port of the suction side three way switch valve (102) and is returned back into the inverter compressor (2). This circulation is repeatedly performed to thereby provide room heating (store heating) and storage compartment cooling (cold storage showcase cooling and freeze storage showcase cooling) at the same time. To sum up, the cooling capacity of the cold and freeze storage units (1C, 1D), i.e. the amount of evaporation heat, is out of balance with the heating capacity of the indoor unit (1B), i.e. the amount of condensation heat, and only surplus condensation heat is released outdoors in the outdoor heat exchanger (4).

Third Heating/Refrigeration Operation Mode

The third heating/refrigeration operation mode is a heating capacity deficiency operation mode in which the heating capacity of the indoor unit (1B) becomes deficient in the first heating/refrigeration operation mode. In other words, there is a deficiency in the amount of evaporation heat.

Figure 5:
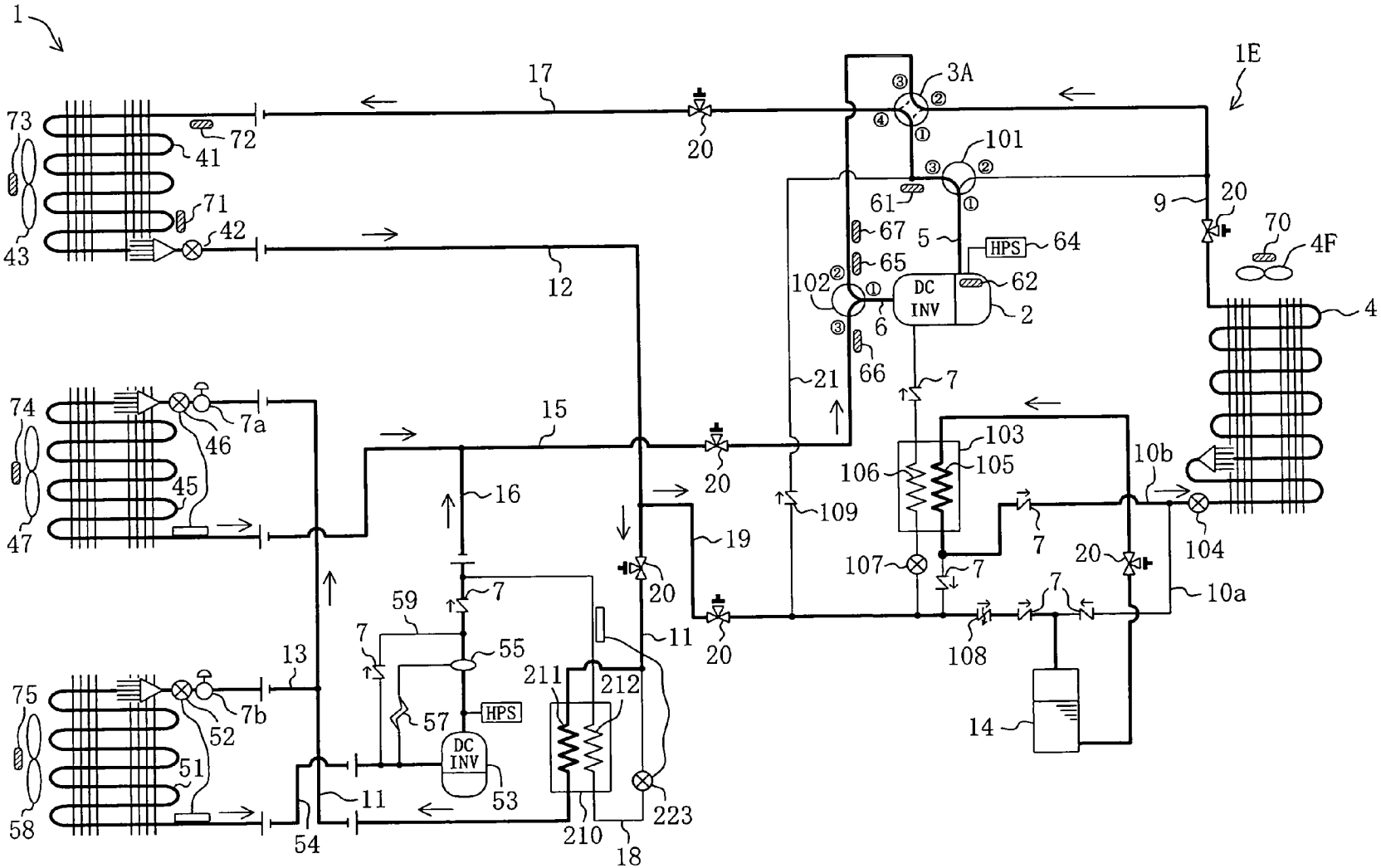
FIG. 5 is a refrigerant circuit diagram which shows the flow of refrigerant during a third heating/refrigeration operation mode in the first embodiment.

The four way switch valve (3A) changes state to the ON state, as indicated by the solid line of FIG. 5. The second port of the discharge side three way switch valve (101) is placed in the closed state. The second and third ports of the suction side three way switch valve (102) are placed in the open state. Furthermore, the solenoid valve (7*a*) of the cold storage unit (1C) and the solenoid valve (7*b*) of the freeze storage unit (1D) are placed in the open state.

Accordingly, as in the first heating/refrigeration operation mode, all of the refrigerant discharged out of the inverter compressor (2) flows into the indoor heat exchanger (41) where the refrigerant condenses to a liquid refrigerant. The liquid refrigerant (i.e., the condensed refrigerant) flows through the second interconnecting liquid pipe (12) into the first interconnecting liquid pipe (11) and into the receiver (14).

Thereafter, one part of the refrigerant flowing through the first interconnecting liquid pipe (11) flows into the cold storage heat exchanger (45) where the one part refrigerant evaporates to a gas refrigerant. On the other hand, the other part of the refrigerant flowing through the first interconnecting liquid pipe (11) flows into the freeze storage heat exchanger (51) where the other part refrigerant evaporates to a gas refrigerant. The gas refrigerant (i.e., the refrigerant evaporated in the cold storage heat exchanger (45)) and the gas refrigerant (i.e., the refrigerant evaporated in the freeze storage heat exchanger (51) and discharged out of the booster compressor (53)) join together in the low pressure gas pipe (15), and the merged gas refrigerant flow passes through the third port of the suction side three way switch valve (102) and is returned back into the inverter compressor (2).

On the other hand, the other liquid refrigerant which has flowed into the side of the receiver (14) passes through the second liquid pipe (10*b*) and then through the heating expansion valve (104) and flows into the outdoor heat exchanger (4) where the refrigerant evaporates to a gas refrigerant. The gas refrigerant flows through the outdoor gas pipe (9), passes through the four way switch valve (3A) and then through the suction side three way switch valve (102), and is returned back into the inverter compressor (2).

The above circulation is repeatedly performed to thereby provide room heating (store heating) and storage compartment cooling (cold storage showcase cooling and freeze storage showcase cooling). In other words, the cooling capacity of the cold and freeze storage units (1C, 1D), i.e., the amount of evaporation heat, is out of balance with the heating capacity of the indoor unit (1B), i.e. the amount of condensation heat, and the amount of evaporation heat needed is obtained from the outdoor heat exchanger (4).

Effects of the First Embodiment

As described above, in accordance with the refrigeration apparatus (1) of the first embodiment, the refrigerant discharged out of the compressor (2) is distributed, after being flow-rate controlled by the three way switch valve (101), to the indoor heat exchanger (41) and the outdoor heat exchanger (4). This therefore makes it possible to supply to the indoor heat exchanger (41) only an amount of heat required in the indoor heat exchanger (41) of the heat absorbed in the cold storage heat exchanger (45) and the freeze storage heat exchanger (51) during the heat recovery operation mode (the second heating/refrigeration operation mode), while surplus heat is discharged to the outside in the outdoor heat exchanger (4). Consequently, comfortable air conditioning can be provided by preventing the discharge pressure of the inverter compressor (2) from falling too low. Besides, the heat absorbed in the cold storage heat exchanger (45) and the freeze storage heat exchanger (51) is properly collected, thereby making it possible to accomplish a marked improvement in heat efficiency.

Second Embodiment

The present invention provides a second embodiment which is a modification of the first embodiment in that the controller (80) includes an inhibitor part (81) as an inhibitor means (see FIG. 1).

The inhibitor part (81) is configured such that it inhibits the indoor heat exchanger (41) from lowering in its condensation capacity when the refrigerant flow rate is varied by the discharge side three way switch valve (101) as a flow rate controller means. More specifically, the inhibitor part (81) lowers the air volume of the outdoor fan (4F) of the heat source side heat exchanger (4). If the heating capacity of the indoor heat exchanger (41) falls to an extreme extent during the heat recovery operation mode (the second heating/refrigeration operation mode), the inhibitor part (81) inhibits the heating capacity of the indoor heat exchanger (41) from lowering. In other words, in the case where the heating capacity falls to an extreme extent if the inverter compressor (2) is operated continuously in the same condition, the inhibitor part (81) inhibits such a drop in the heating capacity of the indoor heat exchanger (41).

The inhibitor part (81) lowers the air volume of the outdoor fan (4F) when any condition of the following conditions (a1)-(h1) is met.

(a1): The outdoor air temperature detected by the outside air temperature sensor (70) is lower than a specified temperature value.

(b1): The pressure of high pressure refrigerant of the inverter compressor (2) detected by the high pressure sensor (61) is lower than a specified pressure value.

(c1): The condensation temperature of the indoor heat exchanger (41) detected by the indoor heat exchange sensor (71) is lower than a specified temperature value or the condensation temperature of the outdoor heat exchanger (4) detected by the temperature sensor (not shown) is lower than a specified temperature value.

(d1): The difference between the suction temperature of the indoor unit (1B) detected by the room temperature sensor (73) (the temperature of indoor air) and the set temperature of indoor air is greater than a specified value.

(e1): The indoor air temperature of the indoor unit (1B) detected by the room temperature sensor (73) (the suction temperature) is lower than a specified temperature value.

(f1): In the case where the indoor unit (1B) is installed in plural number, the number of indoor units (1B) in the thermo-off state (i.e., the number of indoor units (1B) in the heating operation stopped state) is less than a specified value.

(g1): The difference between the suction temperature of the cold storage unit (1C) detected by the cold storage temperature sensor (74) (the compartment temperature of the cold storage showcase) and the cold storage compartment set temperature is lower than a specified value or the difference between the suction temperature of the freeze storage unit (1D) detected by the freeze storage temperature sensor (75)

(the compartment temperature of the freeze storage showcase) and the freeze storage compartment set temperature is lower than a specified value.

(h1): The difference between the evaporating temperature of the cold storage heat exchanger (45) detected by the cold storage heat exchange sensor (not shown) provided in the cold storage unit (1C) and the cold storage compartment set temperature is lower than a specified value or the difference between the evaporating temperature of the freeze storage heat exchanger (51) detected by the freeze storage heat exchange sensor (not shown) provided in the freeze storage unit (1D) and the freeze storage compartment set temperature is lower than a specified value.

When any one of the above conditions (a1)-(h1) is met, the heating capacity will fall to an extreme extent. Therefore, the air volume of the outdoor fan (4F) is decreased to thereby inhibit the heating capacity from lowering. This ensures without fail that the indoor heat exchanger (41) secures a specified heating capacity. On the other hand, when such a condition becomes no longer existent, the air volume of the outdoor fan (4F) is increased to its original air volume value. The other configurations, operations, and working-effects of the second embodiment are the same as the first embodiment.

Third Embodiment

The present invention provides a third embodiment in which, contrary to the second embodiment in which the air volume of the outdoor fan (4F) is decreased by the inhibitor part (81), either the air volume of the cold storage fan (47) of the cold storage heat exchanger (45) or the air volume of the freeze storage fan (58) of the freeze storage heat exchanger (51) is increased by the inhibitor part (81). Stated another way, the inhibitor part (81) forcibly increases either the evaporating capacity of the cold storage heat exchanger (45) or the evaporating capacity of the freeze storage heat exchanger (51), thereby inhibiting the heating capacity from lowering. The air volume of the cold storage fan (47) or the air volume of the freeze storage fan (58) is increased under the same conditions as the second embodiment, i.e., whenever any condition of the conditions (a1)-(h1) is met. The other configurations, operations, and working-effects are the same as the second embodiment.

Fourth Embodiment

The present invention provides a fourth embodiment in which, contrary to the second embodiment in which the air volume of the outdoor fan (4F) is decreased by the inhibitor part (81), either the opening of the cold storage expansion valve (46) or the opening of the freeze storage expansion valve (52) is increased. Stated another way, the inhibitor part (81) forcibly increases the evaporating capacity of the cold storage heat exchanger (45) or the evaporating capacity of the freeze storage heat exchanger (51), thereby inhibiting the heating capacity from lowering. The opening of the cold storage expansion valve (46) or the opening of the freeze storage expansion valve (52) is increased under the same conditions as the second embodiment, i.e., whenever any condition of the conditions (a1)-(h1) is met. The other configurations, operations, and working-effects are the same as the second embodiment. The cold storage expansion valve (46) or the freeze storage expansion valve (52) in the fourth embodiment is not an expansion valve of the temperature sensing type but is formed by a motor operated expansion valve the opening of which is controlled so that the degree of superheat, which is a difference between the refrigerant evaporating temperature of the heat exchanger (45, 51) detected by a temperature sensor and the gas refrigerant temperature at the exit thereof detected by a temperature sensor, becomes a specified temperature value.

Fifth Embodiment

The present invention provides a fifth embodiment in which, contrary to the second embodiment in which the air volume of the outdoor fan (4F) is decreased by the inhibitor part (81), the inhibitor part (81) increases the volume of the inverter compressor (2). In other words, the inhibitor part (81) forcibly increases the operating capacity of the inverter compressor (2), thereby inhibiting the heating capacity from lowering. The volume of the inverter compressor (2) is increased under the same conditions as the second embodiment, i.e., whenever any condition of the conditions (a1)-(h1) is met. The other configurations, operations, and working-effects are the same as the second embodiment.

Sixth Embodiment

The present invention provides a sixth embodiment in which, contrary to the second embodiment in which the air volume of the outdoor fan (4F) is decreased by the inhibitor part (81), the inhibitor part (81) increases the number of inverter compressors (2) to be operated. In other words, the inhibitor part (81) forcibly increases the number of inverter compressors (2) to be operated, thereby inhibiting the heating capacity from lowering. The number of inverter compressors (2) to be operated is increased under the same conditions as the second embodiment, i.e., whenever any condition of the conditions (a1)-(h1) is met. The other configurations, operations, and working-effects are the same as the second embodiment. In the sixth embodiment, the inverter compressors (2) are connected in parallel with each other.

Seventh Embodiment

The present invention provides a seventh embodiment in which, contrary to the second embodiment in which the air volume of the outdoor fan (4F) is decreased by the inhibition part (81), the inhibitor part (81) establishes a bypass between the discharge and suction sides of the inverter compressor (2).

Figure 6:
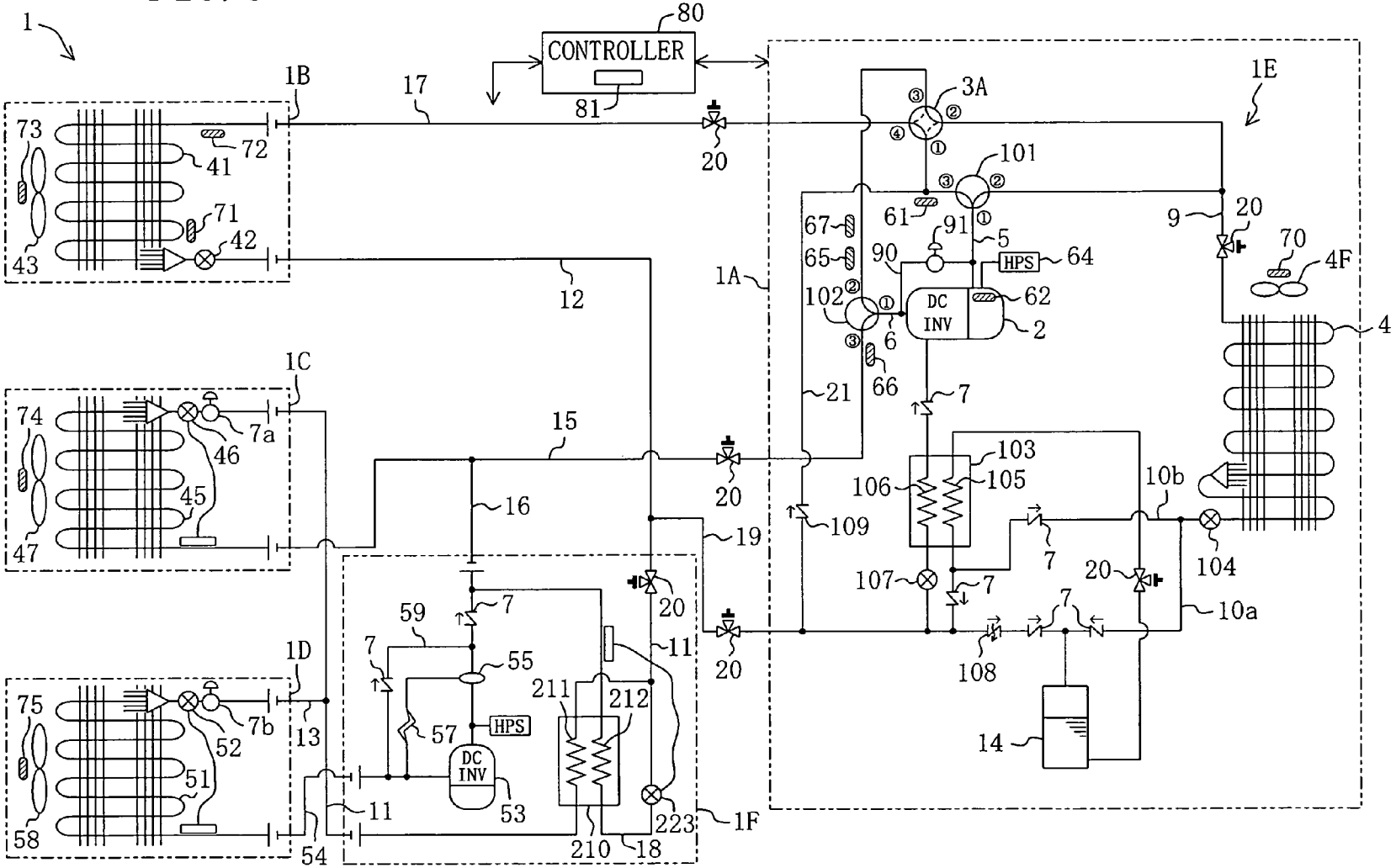
FIG. 6 is a refrigerant circuit diagram which shows the flow of refrigerant during a heating operation mode in a seventh embodiment of the present invention.

As shown in FIG. 6, an auxiliary passageway (90) is connected between the discharge and suction pipes (5, 6) of the inverter compressor (2). The auxiliary passageway (90) is provided with an auxiliary valve (91) as a switch mechanism. The following are conditions under which the inhibitor part (81) places the auxiliary valve (91) in the open state so that the auxiliary passageway (90) is made fluidly communicative.

(a2): The outdoor air temperature detected by the outside air temperature sensor (70) is higher than a specified temperature value.

(b2): The pressure of high pressure refrigerant of the inverter compressor (2) detected by the high pressure sensor (61) is higher than a specified pressure value.

(c2): The condensation temperature of the indoor heat exchanger (41) detected by the indoor heat exchange sensor (71) is lower than a specified temperature value or the condensation temperature of the outdoor heat exchanger (4) detected by the temperature sensor (not shown) is higher than a specified temperature value.

(d2): The difference between the suction temperature of the indoor unit (1B) detected by the room temperature sensor (73) (the temperature of indoor air) and the set temperature of indoor air is less than a specified value.

(e2): The indoor air temperature of the indoor unit (1B) detected by the room temperature sensor (73) (the suction temperature) is higher than a specified temperature value.

(f2): In the case where the indoor unit (1B) is installed in plural number, the number of indoor unit (1B) in the thermo-off state (i.e., the number of indoor units (1B) in the heating operation stopped state) is greater than a specified value.

That is to say, when any condition of the above conditions (a1)-(h1) is met, the heating capacity will fall to an extreme extent due to the storage of liquid refrigerant in the indoor heat exchanger (41). Therefore, the amount of refrigerant to be supplied is reduced to thereby inhibit the heating capacity from lowering. This ensures without fail that the indoor heat exchanger (41) secures a specified heating capacity. On the other hand, when such a condition becomes no longer existent, the auxiliary valve (91) is closed. The other configurations, operations, and working-effects are the same as the second embodiment.

Eighth Embodiment

The present invention provides an eighth embodiment in which, contrary to the second embodiment in which the air volume of the outdoor fan (4F) is decreased by the inhibition part (81), the inhibitor part (81) increases the air volume of the indoor fan (43) of the indoor heat exchanger (41). In other words, the inhibitor part (81) forcibly increases the condensing capacity of the indoor heat exchanger (41), thereby inhibiting the heating capacity from lowering. The air volume of the indoor fan (43) is increased under the same conditions as the seventh embodiment, i.e., whenever any condition of the conditions (a2)-(f2) is met. The other configurations, operations, and working-effects are the same as the second embodiment.

Other Embodiments

With respect to the foregoing first to eighth embodiments, the present invention may be configured as follows.

In the first to eighth embodiments, the discharge side three way switch valve (101) serves as a flow rate controller means capable of flow rate control. The three way switch valve (101) may be formed in a simple structure without a flow rate control function. In this case, the three way switch valve (101) and the heating expansion valve (104) form a flow rate controller means wherein the opening of the heating expansion valve (104) connected to the end which becomes a downstream side end thereof during the heat recovery operation mode is controlled so that the refrigerant discharged out of the inverter compressor (2) is distributed in proper amounts to the indoor heat exchanger (41) and the outdoor heat exchanger (4). In this case, as a flow rate controller means, any four way switch valve having a simple structure without a flow rate control function may be employed. In any case, the refrigeration apparatus (1) with high efficiency can be obtained, as in the foregoing embodiments.

INDUSTRIAL APPLICABILITY

As has been described above, the present invention finds useful application in the field of refrigeration apparatuses with air conditioning heat exchangers and cooling heat exchangers for use in convenience stores, supermarkets et cetera.

What is claimed is:

1. A refrigeration apparatus comprising a refrigerant circuit along which are connected a compressor, a heat source side heat exchanger, an expansion mechanism, an air conditioning heat exchanger for providing room air conditioning, and a cooling heat exchanger for providing storage compartment cooling, wherein:

the refrigerant circuit includes flow rate controller unit capable of varying the flow rate of refrigerant discharged out of the compressor and then distributed to the air conditioning heat exchanger and the heat source side heat exchanger during a heat recovery operation mode in which the air conditioning heat exchanger and the heat source side heat exchanger operate as condensers; and the flow rate controller unit is formed by a three way switch valve which is connected to a discharge pipe of the compressor and which is capable of flow path switching and flow rate control.

2. A refrigeration apparatus comprising a refrigerant circuit along which are connected a compressor, a heat source side heat exchanger, an expansion mechanism, an air conditioning heat exchanger for providing room air conditioning, and a cooling heat exchanger for providing storage compartment cooling, wherein:

the refrigerant circuit includes flow rate controller unit capable of varying the flow rate of refrigerant discharged out of the compressor and then distributed to the air conditioning heat exchanger and the heat source side heat exchanger during a heat recovery operation mode in which the air conditioning heat exchanger and the heat source side heat exchanger operate as condensers; and the flow rate controller unit is composed of a three way switch valve which is connected to a discharge pipe of the compressor and which is capable of flow path switching and an expansion valve which is connected to an end of the heat source side heat exchanger, the end serving as a downstream side thereof during the heat recovery operation mode, and an opening of which is controllable.

3. A refrigeration apparatus comprising a refrigerant circuit along which are connected a compressor, a heat source side heat exchanger, an expansion mechanism, an air conditioning heat exchanger for providing room air conditioning, and a cooling heat exchanger for providing storage compartment cooling, wherein:

the refrigerant circuit includes flow rate controller unit capable of varying the flow rate of refrigerant discharged out of the compressor and then distributed to the air conditioning heat exchanger and the heat source side heat exchanger during a heat recovery operation mode in which the air conditioning heat exchanger and the heat source side heat exchanger operate as condensers; and inhibitor unit is provided which inhibits a condensing capacity of the air conditioning heat exchanger from lowering when the refrigerant flow rate is varied by the flow rate controller unit.

4. The refrigeration apparatus of claim 3, wherein the inhibitor unit decreases the air volume of a heat source fan of the heat source side heat exchanger.

5. The refrigeration apparatus of claim 3, wherein the inhibitor unit increases the air volume of a cooling fan of the cooling heat exchanger.

6. The refrigeration apparatus of claim 3, wherein:

the expansion mechanism of the cooling heat exchanger is formed by an expansion valve the opening of which is controllable; and the inhibitor unit increases the opening of the expansion mechanism of the cooling heat exchanger.

7. The refrigeration apparatus of claim 3, wherein:

the compressor has a variable volume; and the inhibitor unit increases the volume of the compressor.

8. The refrigeration apparatus of claim 3, wherein:

the compressor is provided in plural number; and the inhibitor unit increases the number of compressors of the plural compressors to be operated.

9. The refrigeration apparatus of claim 3, wherein:

an auxiliary passageway is provided allowing the refrigerant to be bypassed between the discharge and suction sides of the compressor; and the auxiliary passageway is made fluidly communicative by the inhibitor unit.

10. The refrigeration apparatus of claim 3, wherein the inhibitor unit increases the air volume of an air conditioning fan of the air conditioning heat exchanger.

* * * * *